US005299979A

United States Patent [19]

Ballard

[11] Patent Number: 5,299,979

[45] Date of Patent: Apr. 5, 1994

[54] SHIPPING FORM WITH LABEL

[75] Inventor: Patricia A. Ballard, Manchester, N.H.

[73] Assignee: Moore Business Forms, Inc., Grand Island, N.Y.

[21] Appl. No.: 59,312

[22] Filed: May 11, 1993

[51] Int. Cl.[5] ..... B42D 15/00

[52] U.S. Cl. ..... 462/18; 283/81

[58] Field of Search ..... 462/8, 9, 17, 18, 19, 462/22, 66, 69; 283/81, 101

[56] References Cited

U.S. PATENT DOCUMENTS

| | | | |
|---|---|---|---|
| 3,987,960 | 10/1976 | Gardiner | 229/74 |
| 4,021,060 | 5/1977 | Seeley et al. | 282/28 R |
| 4,153,163 | 5/1979 | Alderman et al. | 206/610 |
| 4,394,038 | 7/1983 | Klein | 282/1 R |
| 4,403,793 | 9/1983 | McCormick et al. | 283/105 |
| 4,429,827 | 2/1984 | Murray | 229/68 R |
| 4,667,984 | 5/1987 | Nitta | 282/8 R |
| 4,688,826 | 8/1987 | Hosoya | 283/79 |
| 4,708,368 | 11/1987 | Instance | 283/81 |
| 4,711,686 | 12/1987 | Instance | 156/227 |
| 4,927,179 | 5/1990 | Ehret et al. | 283/79 |
| 4,928,874 | 5/1990 | Henry et al. | 229/74 |
| 4,938,507 | 7/1990 | Ashby et al. | 462/19 |
| 4,955,640 | 9/1990 | Anderson | 281/2 |
| 4,995,642 | 2/1991 | Juszak et al. | 283/105 |
| 5,002,311 | 3/1991 | Brunjes | 282/9 R |
| 5,127,880 | 7/1992 | Bar et al. | 462/18 |

FOREIGN PATENT DOCUMENTS 0133806 3/1985 European Pat. Off. .

*Primary Examiner*—Mark Rosenbaum
*Assistant Examiner*—William Fridie, Jr.
*Attorney, Agent, or Firm*—Nixon & Vanderhye

[57] ABSTRACT

A two part shipping form has top and bottom plies with a shipping label operatively mounted on the second ply. Image transfer mechanisms, such as CF and CB coatings, are provided on the bottom of the first ply and the top face of the label and the second ply. Beneath the pressure sensitive adhesive of the label is a silicone coating or a transparent release material ply to allow the label to be removed from the second ply. Beneath the silicone coating is a self-contained spot, so that indicia written on the top ply transfers to the top face of the label and to the top face of the second ply beneath the label. The forms are made on presses and by blowing the label, with or without the transparent midply, onto the second ply.

20 Claims, 4 Drawing Sheets

SHIPPING FORM WITH LABEL

BACKGROUND AND SUMMARY OF THE INVENTION

Business forms used for shipping, such as courier packages, are usually three or more plies. One ply is retained by the customer, one ply needs to be retained for the records of the courier service, or other shipping organization, while a third ply needs to be affixed to the package being shipped. However, there are some circumstances when a multi-ply form like this is undesirable, and it would be better to have a two ply construction for ease of handling, transfer of images onto the courier services record ply, etc.

According to the present invention, it has been recognized that the ply that is used to attach to the package need not necessarily contain all of the information that the customer and record plies contain. Rather, the primary information that needs to be provided on the package itself is the name and address of the addressee. Utilizing this information, according to the present invention a shipping form is provided that has a basically two part construction, with a label that covers only a part of the form (underneath the addressee indicia, and preferably under both the return address and addressee indicia). The invention also relates to a method for easily producing the two part forms, with labels, according to the invention. The labels have sufficient information thereon to make sure that the package to which they are applied is properly directed.

According to one aspect of the present invention a shipping form is provided which comprises the following elements: A first ply having a top face and a bottom face, with indicia on the top face. A second ply having a top face and a bottom face, with indicia on the top face. Means for readily releasably attaching a small part of the first ply bottom face to a small part of the second ply top face. A label assembly comprising a label ply having top and bottom faces, with pressure sensitive adhesive substantially covering the label bottom face. The label having dimensions significantly less than the dimensions of the first and second plies. The label disposed on the second ply beneath the first ply, the top face of the label operatively associated with the bottom face of the second ply, and the label covering a first portion of the top face of the second ply, and the second ply top face having a second portion not covered by the label. First image transfer means for transferring indicia impressed on the first ply top face to the label ply top face and to the second portion of the second ply top face. Adhesive release means provided beneath the label pressure sensitive adhesive in operative association with the second ply top face, for allowing removal of the label therefrom. And self-contained second image transfer means disposed on the first portion of the top face of the second ply, beneath the label pressure sensitive adhesive and the adhesive release means, for transferring indicia impressed on the first ply top face through the label to the second ply top face.

Preferably, the shipping form consists of only the above recited elements. That is, the bottom face of the second ply is not coated with adhesive or another material, and there are no other parts to the form.

Preferably the first image transfer means comprises a CB coating on the bottom face of the first ply, and a CF coating on the top face of the label and on the top face of the label and on the top face of the second portion of the second ply. The second image transfer means comprises a combined CB/CF coating on the top face of the second ply first portion, such as is provided by merely spot coating a part of the CF coated second ply with CB.

The adhesive release means preferably has one of two alternative constructions. It may be a transparent ply having dimensions slightly greater than the dimensions of the label, and having a top face engaging the pressure sensitive adhesive of the label. The bottom face of the transparent ply is then attached by pressure sensitive adhesive to the second image transfer means. Alternatively, the adhesive release means may comprise a transparent release coating (silicone) having dimensions slightly greater than the dimensions of the label, and provided over the second image transfer means.

The label typically comprises a blow on label assembly, with preprinted indicia on the top face thereof, such as "To" and "From", etc. The first and second plies are typically paper plies and have aligned indicia indicating insertion of outgoing addressee information, and preferably also return address information.

According to another aspect of the present invention, a method of making a two part shipping form is provided. The method comprises the following steps: (a) Printing the top face of a first ply in web form. (b) Printing the top face of a second ply in web form. (c) Applying a CF coating to the top face of a web of label material. (d) Die cutting the web of label material, and removing the matrix from die cutting. (e) Applying a self-contained coating to the top face of a first portion of the second ply. (f) Providing an image transfer mechanism between the bottom face of the first ply and a second portion of the top face of the second ply, distinct from the first portion. (g) Blowing the label onto the first portion of the top face of the second ply. (h) Providing a release material associated with the label to allow release of the label from the second ply top face first portion. And (i) collating the plies together to form a two part shipping form with the first ply on top of the second ply.

Step (h) may be practiced by providing a silicone coating over the self-contained coating on the top face first portion of the second ply, and step (g) may be practiced without a midply. Alternatively, step (g) is practiced with a transparent midply, and step (h) is practiced simultaneously with step (g), the transparent midply forming the release material.

Steps (e) and (f) are preferably practiced by applying a CB coating to the bottom face of the first ply, a CF coating to the top face of the second ply, and a CB spot over the CF coating to the first portion of the top face of the second ply. The top face of the label may be printed prior to step (c).

It is a primary object of the present invention to provide a simple yet useful two part shipping form, particularly for courier services. This and other objects of the invention will become clear from an inspection of the detailed description of the invention and from the appended claims.

DETAILED DESCRIPTION OF THE DRAWINGS

Figure 1:
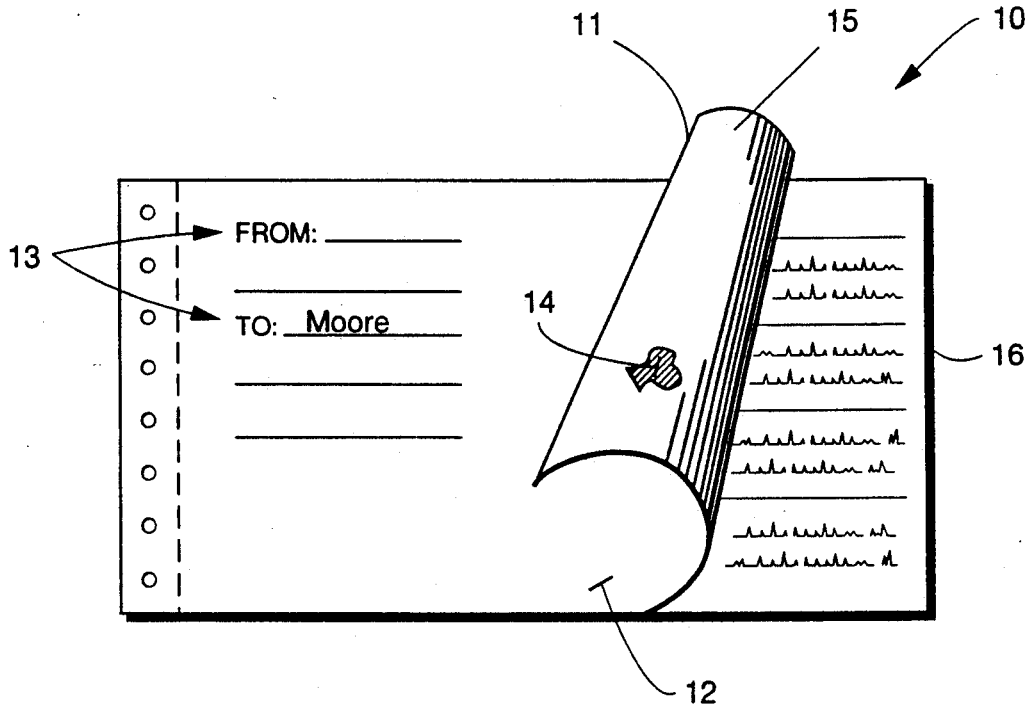
FIG. 1 is a top plan view, with a portion of the top ply peeled back, of an exemplary shipping form according to the present invention.
Figure 2:
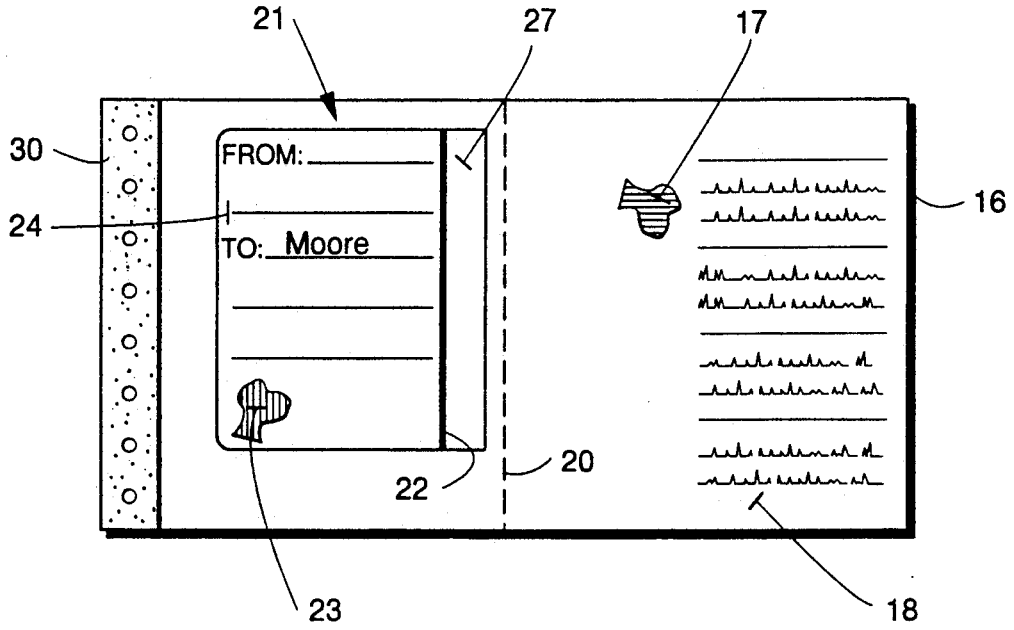
FIG. 2 is a plan view of a first embodiment of shipping form according to the invention when the top ply of FIG. 1 has been completely removed.

An exemplary shipping form according to the present invention is shown generally by reference numeral 10 in FIGS. 1 and 2. The form includes a first, preferably paper, ply 11 (see FIGS. 1 and 4) having a top surface 12 within indicia thereon, such as indicia "From" and "To" indicated by reference numeral 13 in FIG. 1, as well as various lines to fill in address information, shipping bill numbers, etc. The first ply 11 also has a bottom face 14 (see FIG. 1) on which an image transfer means is preferably provided, such as the CB coating 15. Alternatively, instead of the CB coating carbon paper could be utilized, although that would make the form more bulky.

FIG. 2 illustrates the complete second ply 16 of the form 10, only the rightmost portion of which is seen in FIG. 1. The second ply 16 also preferably is of paper, and has a top surface 17 (see FIG. 2) on which a CF coating 18 is preferably provided, the CF coating 18 preferably covering substantially the entire top surface 17 of the second ply 16. The second ply 16 also has a bottom face 19 (see FIG. 4) which is uncoated with adhesive or any other material (that is, is just plain paper). The top face 17 of the second ply 16 also has indicia printed thereon such as the indicia 13' like the indicia 13 on the first ply 11, or various other indicia such as shipping bill number, spaces for weight, date, etc.

The second ply 16 typically has two portions, a first portion to the left of the imaginary line illustrated at 20 in FIG. 2, and the second portion to the right thereof in FIG. 2.

Associated with the first portion of the top face 17 of the second ply 16 is a label assembly and adhesive release means. The label assembly may include the adhesive release means as a part thereof, or the adhesive release means may be separate. In the embodiment illustrated in FIGS. 2 through 4, the label assembly has the adhesive release means as a part thereof.

Figure 3:
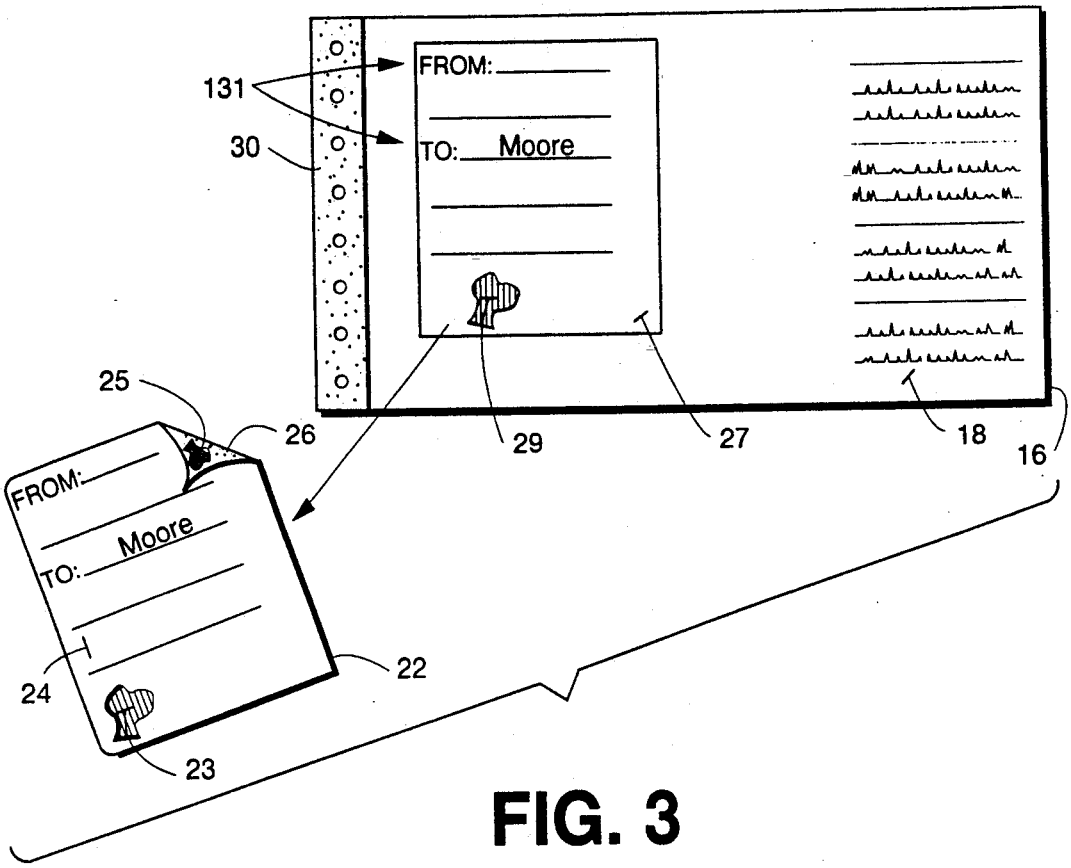
FIG. 3 is a view like that of FIG. 2 only showing the label on the second ply having been removed, and with a portion of the adhesive release means on the second ply cut away.
Figure 4:
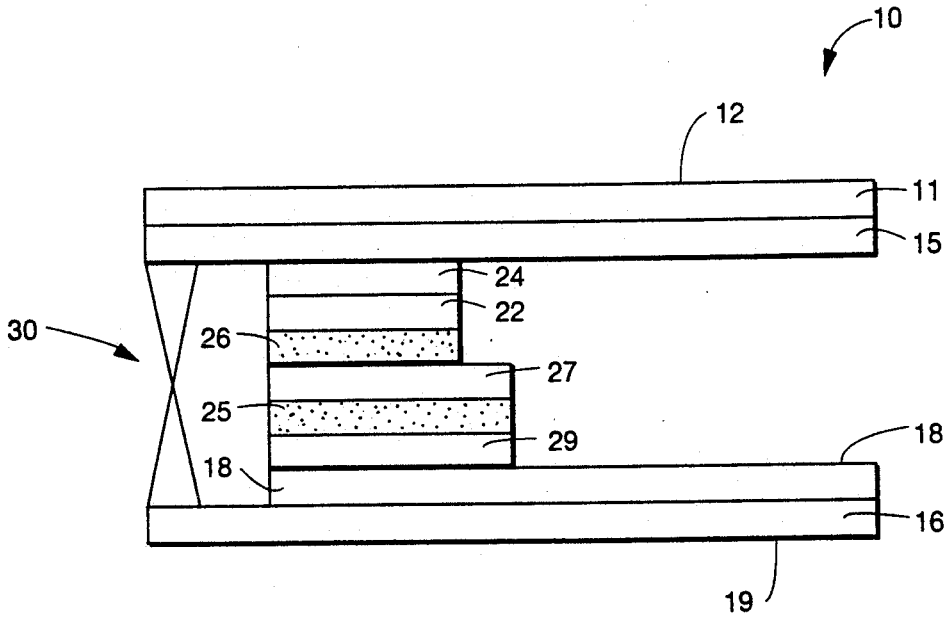
FIG. 4 is a view of the form of FIGS. 1 and 2 with all the various components greatly exaggerated in size for clarity of illustration.

The label assembly, shown generally by reference numeral 21 in FIG. 2, includes a label 22 (see FIGS. 2 through 4) which has a top surface 23 (see FIGS. 2 and 3) on which a CF coating 24 or like image transfer means is provided. It also includes a bottom face 25 (see FIG. 3) which is covered at least in part, and preferably completely, with pressure sensitive adhesive 26 (FIGS. 3 and 4).

Associated with the top surface 17 of the second ply 16 is the adhesive release means in the form of a transparent midply 27 which has dimensions slightly greater than the dimensions of the label 22 and is provided beneath the label 22. The midply 27 preferably has a pressure sensitive adhesive coating 28 (see FIG. 4) on the bottom face thereof which is in operative association with the second ply 16.

In order to transfer an image impressed on the top ply 11 to the first portion of the second ply 16 (beneath the midply 27), a second image transfer means in the form of a CB coating 29 (see FIGS. 3 and 4) is preferably provided. The CB coating 29 covers the CF coating 18 that is already over the entire top surface 17 of the second ply 16, thereby providing a self imaging spot on ply 16 beneath the midply 27.

The shipping form 10 also includes means for readily releasably attaching a small part of the first ply bottom face 14 to a small part of the second ply 16 top face 17. This is preferably in the form of an adhesive, shown generally by reference numeral 30 in FIGS. 2 and 4, which can take the form of a continuous strip, discontinuous dots, or the like.

Figure 5:
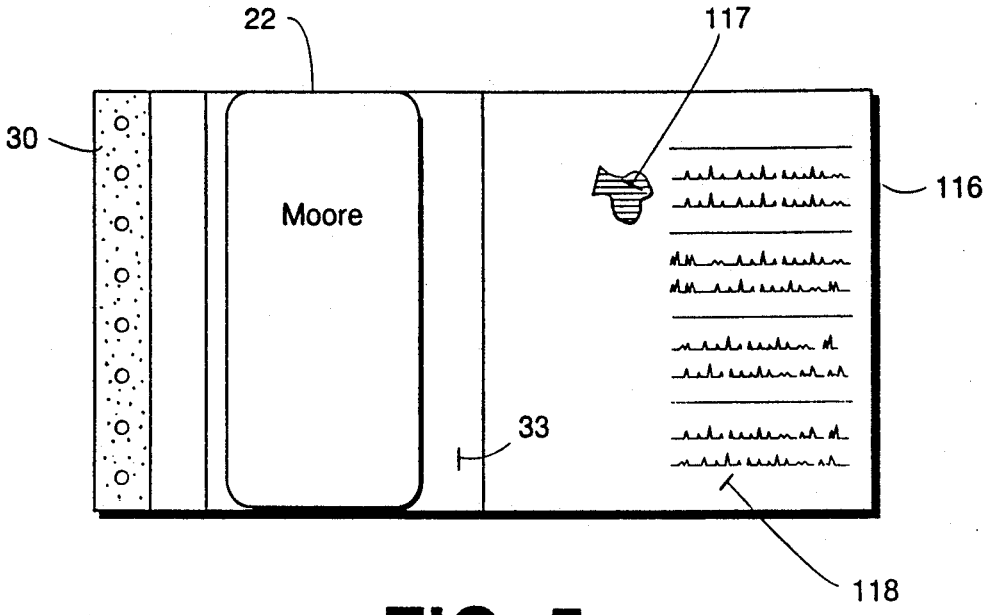
FIGS. 5 through 7 are views like those of FIGS. 2 through 4 only for a second exemplary embodiment of shipping form according to the present invention.
Figure 6:
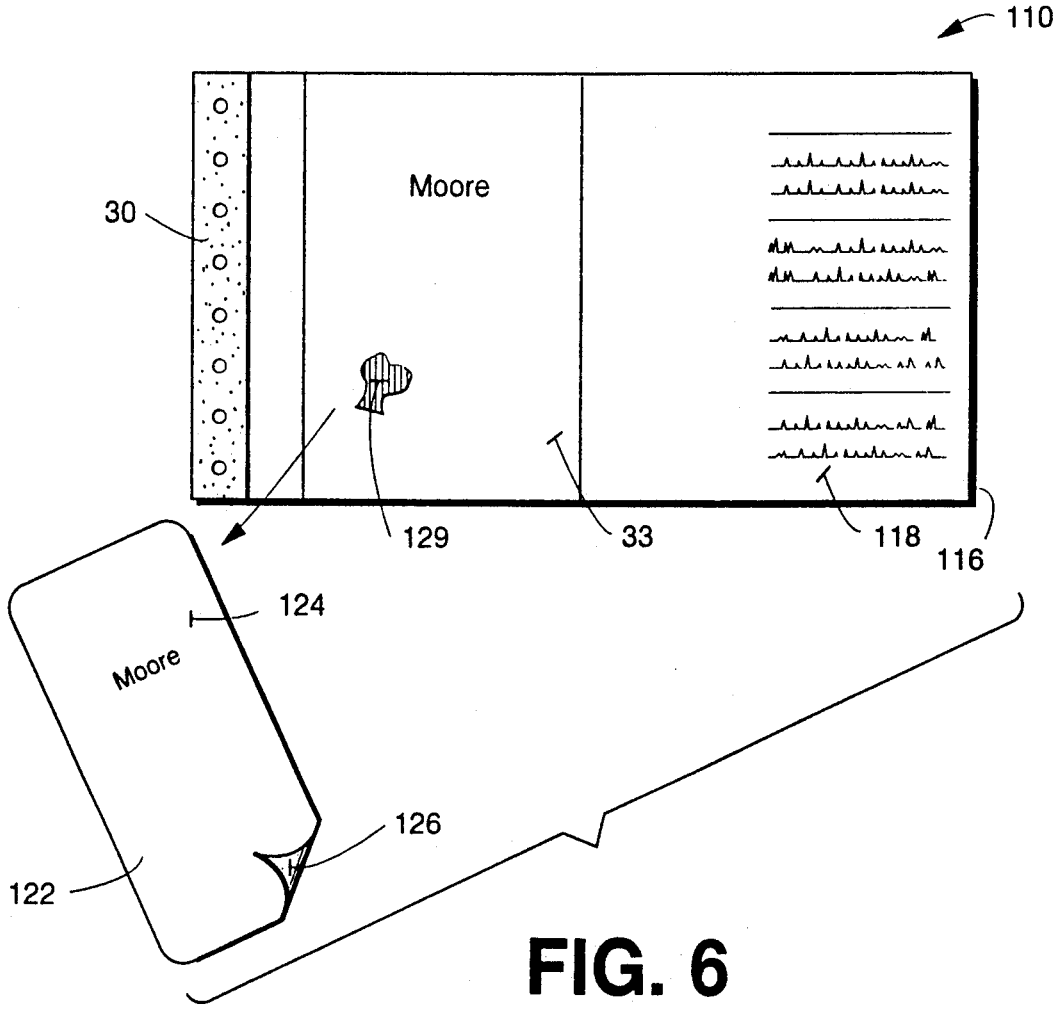
Figure 7:
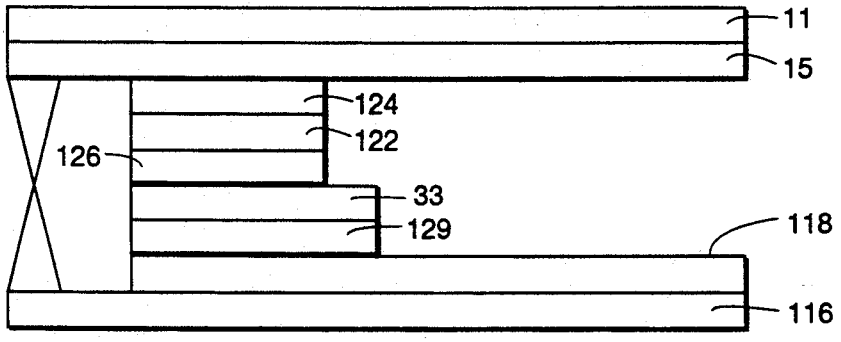

FIGS. 5 through 7 are comparable to FIGS. 2 through 4 only they show a different embodiment of the second ply. The first ply 11 is identical. In the FIGS. 5 through 7 embodiment components comparable to those in the FIGS. 2 through 4 embodiment are shown by the same reference numeral only preceded by a "1".

The only difference between the second ply 116 and the second ply 16 is that the adhesive release means in the FIGS. 5 through 7 embodiment does not comprise part of the label assembly 21, but rather comprises a coating of silicone (or other release material) 33 provided directly over the CF coating 118 on the top face 117 of the second ply 116. The adhesive 126 from the label 122 will not adhere to the silicone coating 33.

The use of the shipping form 10 is simple. The addressee's name and address is typed, written, or otherwise impressed on the top face 12 of the first ply 11 where the "To" indicia 13 is (see FIG. 1), and if necessary the return address is impressed on the top face 12 where the "From" indicia 13 is. This is transferred to the top face 23 of the label 22 by the CB coating 15 and the CF coating 24, and to the top face 17 of the second ply 16 first portion (underlying the transparent midply 27) by the self-contained spot 29/18. Other indicia impressed on the top face 12 of the first ply 11 on the second portion of the second ply 16 is provided by transfer utilizing the CF coating 15 and CB coating 18.

Once the form 10 has been completely filled out, the first ply 11 is detached from the second ply 16, tearing at the adhesive line 30. Then the label 22 is removed from the second ply 16 by grasping an edge portion thereof (where the midply 27 overlaps it), and peeling away, as illustrated in FIG. 3, the pressure sensitive adhesive 26 releasing from the transparent midply 27. The label 22 is then applied to the package to be sent/shipped, the customer keeps the first ply 11, while the shipping company keeps the second, record ply 16.

Figure 8:
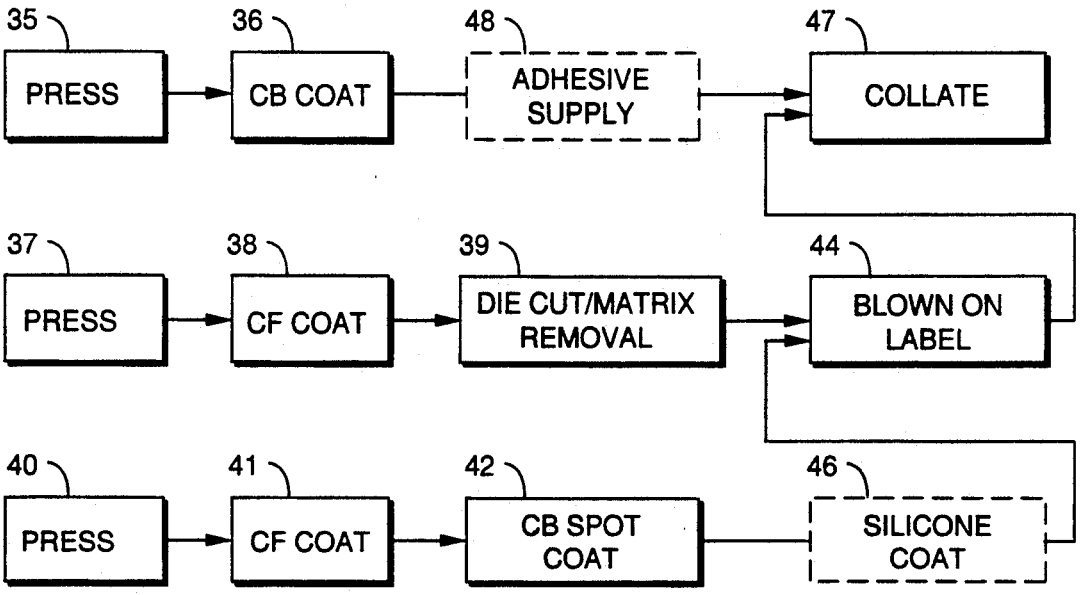
FIG. 8 is a schematic illustrating exemplary method steps that may be practiced according to the present invention.

FIG. 8 schematically illustrates exemplary procedures for making the shipping forms 10, 110. The first ply in web (roll) form is run on a Webtron press 35, with the indicia 13, and any other desired indicia, printed thereon. Either before or after printing the CB coat 15 is applied as indicated at stage 36. Meanwhile, a roll of label material is being acted upon on another Webtron press 37, and any desired indicia (such as corresponding to the indicia 13, as indicated at 13' in FIG. 3) is printed thereon. Then a CF coating 24 is applied as indicated at 38, and then it is die cut with the matrix removed, as indicated at 39.

Also at the same time, on another Webtron press 40 the second ply 16, in web (roll) form, is printed with much the same indicia as the first ply 11. Then a CF coating 18 is applied thereto, as indicated at 41, and the CB spot coat 29 is applied as indicated at 42.

When the form 10 is being constructed, the label assembly, with transparent midply 27, and adhesive 28 on the bottom face thereof, is blown onto the second ply CB spot coat 29, as indicated at 44 in FIG. 8, utilizing the conventional label blow-on equipment. When the shipping form 110 is being constructed, after stage 42 the second ply 16 will have a silicone coat 33 applied thereto as indicated at stage 46 in FIG. 8, and then when the label is blown on at stage 44 it does not have the midply, but rather the adhesive 26 is blown directly onto the silicone coating 33.

After the blow-on stage 44, the plies 16, 11, which may still be in web form, or may be in sheet form, are collated as indicated at 47 in FIG. 8. Adhesive 30 may be applied at any point, as indicated schematically at 48 in FIG. 8.

It will thus be seen that according to the present invention a simple yet highly useful two part shipping form and method of manufacture thereof, are provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products and methods.

What is claimed is:

1. A shipping form, comprising;

a first ply having a top face and a bottom face, with indicia on said top face;

a second ply having a top face and a bottom face, with indicia on said top face;

means for readily releasably attaching a small part of said first ply bottom face to a small part of said second ply top face;

a label assembly comprising a label ply having top and bottom faces, with pressure sensitive adhesive substantially covering said label bottom face;

said label having dimensions significantly less than the dimensions of said first and second plies;

said label disposed on said second ply beneath said first ply, said top face of said label operatively associated with said bottom face of said second ply, and said label covering a first portion of said top face of said second ply, and said second ply top face having a second portion not covered by said label;

first image transfer means for transferring indicia impressed on said first ply top face to said label ply top face and to said second portion of said second ply top face;

adhesive release means provided beneath said label pressure sensitive adhesive in operative association with said second ply top face, for allowing removal of said label therefrom; and self-contained second image transfer means disposed on said first portion of said top face of said second ply, beneath said label pressure sensitive adhesive and said adhesive release means, for transferring indicia impressed on said first ply top face through said label to said second ply top face.

2. A shipping form as recited in claim 1 consisting essentially of said first and second plies, said label assembly, said first and second image transfer means, and said adhesive release means.

3. A shipping form as recited in claim 1 wherein said second ply is a paper ply having said bottom face thereof uncoated with any material.

4. A shipping form as recited in claim 1 wherein said first image transfer means comprises a CB coating on said bottom face of said first ply, and a CF coating on said top face of said label and on said top face of said second portion of said second ply.

5. A shipping form as recited in claim 4 wherein said second image transfer means comprises a combined CB/CF coating on said top face of said second ply first portion.

6. A shipping form as recited in claim 5 wherein said adhesive release means comprises a transparent ply having dimensions slightly greater than the dimensions of said label, having a top face engaging said pressure sensitive adhesive of said label, having a bottom face, and said bottom face attached by pressure sensitive adhesive to said second image transfer means.

7. A shipping form as recited in claim 5 wherein said adhesive release means comprises a transparent release coating having dimensions slightly greater than the dimensions of said label, and provided over said second image transfer means.

8. A shipping form as recited in claim 1 wherein said first and second plies are paper plies, said first ply and said second ply first portion having aligned indicia indicating insertion of outgoing addressee information.

9. A shipping form as recited in claim 1 wherein said label assembly comprises a blow on label assembly.

10. A shipping form as recited in claim 1 wherein said second image transfer means comprises a combined CB/CF coating on said top face of said second ply first portion.

11. A shipping form as recited in claim 1 wherein said adhesive release means comprises a transparent ply having dimensions slightly greater than the dimensions of said label, having a top face engaging said pressure sensitive adhesive of said label, having a bottom face, and said bottom face attached by pressure sensitive adhesive to said second image transfer means.

12. A shipping form as recited in claim 1 wherein said adhesive release means comprises a transparent release coating having dimensions slightly greater than the dimensions of said label, and provided over said second image transfer means.

13. A shipping form as recited in claim 2 wherein said adhesive release means comprises a transparent ply having dimensions slightly greater than the dimensions of said label, having a top face engaging said pressure sensitive adhesive of said label, having a bottom face, and said bottom face attached by pressure sensitive adhesive to said second image transfer means.

14. A shipping form as recited in claim 2 wherein said adhesive release means comprises a transparent release coating having dimensions slightly greater than the dimensions of said label, and provided over said second image transfer means.

15. A shipping form as recited in claim 2 further comprising pre-printed indicia on said top face of said label.

16. A method of making a two part shipping form, comprising the steps of:

(a) printing the top face of a first ply in web form;

(b) printing the top face of a second ply in web form;

(c) applying a CF coating to the top face of a web of label material;

(d) die cutting the web of label material, and removing the matrix from die cutting;

(e) applying a self-contained coating to the top face of a first portion of the second ply;

(f) providing an image transfer mechanism between the bottom face of the first ply and a second portion of the top face of the second ply, distinct from the first portion;

(g) blowing the label onto the first portion of the top face of the second ply;

(h) providing a release material associated with the label to allow release of the label from the second ply top face first portion; and (i) collating the plies together to form a two part shipping form with the first ply on top of the second ply.

17. A method as recited in claim 16 wherein step (h) is practiced by providing a silicone coating over the self-contained coating on the top face first portion of the second ply, and wherein step (g) is practiced without a midply.

18. A method as recited in claim 16 wherein step (g) is practiced with a transparent midply, and wherein step (h) is practiced simultaneously with step (g), the transparent midply forming the release material.

19. A method as recited in claim 16 wherein steps (e) and (f) are practiced by applying a CB coating to the bottom face of the first ply, a CF coating to the top face of the second ply, and a CB spot over the CF coating on the first portion of the top face of the second ply.

20. A method as recited in claim 16 comprising the further step of printing the top face of the label prior to step (c).

* * * * *